US008382619B2

(12) United States Patent
Bulfin

(10) Patent No.: US 8,382,619 B2
(45) Date of Patent: Feb. 26, 2013

(54) METHOD FOR PRODUCING A BALL AND BALL

(75) Inventor: Roy William Bulfin, Portlaoise (IE)

(73) Assignee: Puma SE, Herzogenaurach (DE)

( * ) Notice: Subject to any disclaimer, the term of this patent is extended or adjusted under 35 U.S.C. 154(b) by 0 days.

(21) Appl. No.: 13/321,306

(22) PCT Filed: May 10, 2010

(86) PCT No.: PCT/EP2010/002850

§ 371 (c)(1),
(2), (4) Date: Dec. 16, 2011

(87) PCT Pub. No.: WO2010/133305

PCT Pub. Date: Nov. 25, 2010

(65) Prior Publication Data

US 2012/0088614 A1 Apr. 12, 2012

(30) Foreign Application Priority Data

May 20, 2009 (DE) ..... 10 2009 022 252

(51) Int. Cl.
*A63B 41/08* (2006.01)

(52) U.S. Cl. ..... 473/604; 473/597; 156/304.2; 156/147

(58) Field of Classification Search ..... 473/603–605, 473/600, 596, 597, 598, 599; 156/146, 147, 156/213, 214, 220, 304.2
See application file for complete search history.

(56) References Cited

U.S. PATENT DOCUMENTS

| | | | | |
|---|---|---|---|---|
| 1,187,029 | A * | 6/1916 | Beebout | 473/604 |
| 2,149,465 | A * | 3/1939 | Riddell | 156/147 |
| 2,214,179 | A * | 9/1940 | Reach | 156/147 |
| 2,280,314 | A * | 4/1942 | Scudder | 156/213 |
| 3,506,265 | A * | 4/1970 | Hiroshi | 473/604 |
| 5,181,717 | A * | 1/1993 | Donntag et al. | 473/605 |
| 5,306,001 | A * | 4/1994 | Shishido et al. | 473/604 |
| 5,542,662 | A * | 8/1996 | Kouzai et al. | 473/605 |
| 6,206,795 | B1 * | 3/2001 | Ou | 473/599 |
| 6,302,815 | B1 * | 10/2001 | Shishido et al. | 473/604 |
| 6,726,583 | B1 * | 4/2004 | Lai | 473/605 |

(Continued)

FOREIGN PATENT DOCUMENTS

| | | |
|---|---|---|
| DE | 197 38 891 A1 | 3/1999 |
| DE | 102 55 092 A1 | 6/2004 |

(Continued)

*Primary Examiner* — Steven Wong
(74) *Attorney, Agent, or Firm* — Lucas & Mercanti, LLP

(57) ABSTRACT

The invention relates to a method for producing a ball (1), especially a soccer ball, comprising the steps: a) Producing a flat, level base material (2), constructed in at least two layers (3, 4, 5, 6, 7) which comprises a cover layer (3) and at least one material layer (4, 5, 6, 7) below said cover layer; b) Cutting out panels (8) of the desired shape from the base material (2); c) Applying the panels (8) to a carrier body (9), especially to a ball bladder. In order to provide a more uniform hardness to the ball across the extend of the circumference, the invention proposes that before, during or after step b) at least the edge region (10) of the panel (8) is heated and a reforming of the edge area (10) takes place, such that the side of the panel (8) which is covered by the cover layer (3) takes on a convex shape (11) in the edges area (10). Furthermore, the invention relates to a ball.

18 Claims, 3 Drawing Sheets

U.S. PATENT DOCUMENTS

Figure 1:
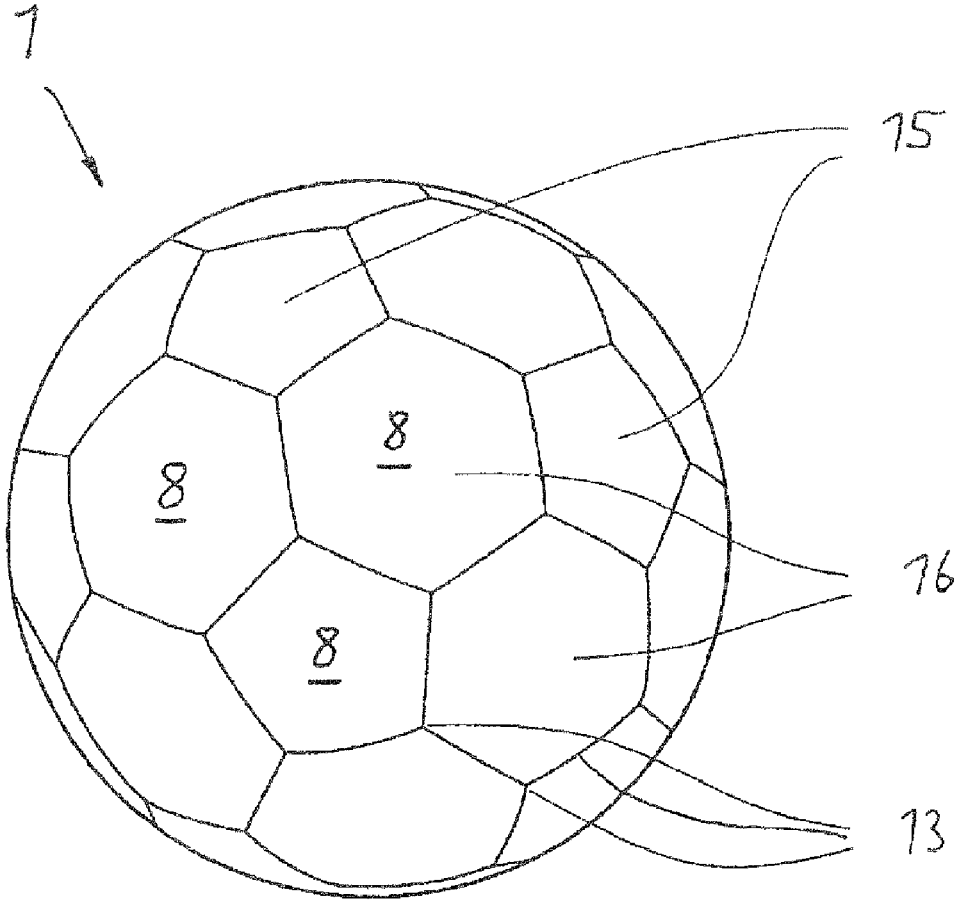

| | | | | |
|---|---|---|---|---|
| 7,066,853 | B2 * | 6/2006 | Chang | 473/605 |
| 7,749,116 | B2 * | 7/2010 | Tang et al. | 473/604 |
| 7,854,815 | B2 * | 12/2010 | Taniguchi et al. | 156/146 |
| 2005/0153803 | A1 * | 7/2005 | Swiszcz et al. | 473/593 |
| 2006/0068951 | A1 | 3/2006 | Chang | |
| 2006/0199685 | A1 * | 9/2006 | Ou | 473/603 |
| 2007/0037642 | A1 * | 2/2007 | Chang | 473/604 |
| 2008/0139349 | A1 * | 6/2008 | Ou | 473/604 |
| 2009/0209374 | A1 * | 8/2009 | Ou | 473/605 |
| 2009/0325747 | A1 * | 12/2009 | Ou | 473/605 |

FOREIGN PATENT DOCUMENTS

| | | | |
|---|---|---|---|
| EP | 1 424 105 | A1 | 6/2004 |
| FR | 2 443 850 | A1 | 7/1980 |
| JP | 58 215335 | A | 12/1983 |

* cited by examiner

METHOD FOR PRODUCING A BALL AND BALL

This application is a 371 of PCT/EP2010/002850 filed May 10, 2010, which in turn claims the priority of DE 10 2009 022 252.9 filed May 20, 2009, the priority of both applications is hereby claimed and both applications are incorporated by reference herein.

The invention relates to a method for producing a ball, especially a soccer ball, comprising the steps: a) Producing a flat, level base material, constructed in at least two layers which comprises a cover layer and at least one material layer below said cover layer; b) Cutting out panels of the desired shape from the base material; c) Applying the panels to a carrier body, especially to a ball bladder. Furthermore, the invention relates to a ball, especially to a soccer ball.

In DE 102 55 092 A1 a method of this kind is described as state of the art. Hereafter, the panels made of a plane and as the case may be multi-layer material are cut out which are required to cover a surface of a sphere. Mostly, those panels have a pentagonal or hexagonal shape to parquet the surface of the ball according to the so-called Euler's formula.

For the production of the single panels it is proposed in the mentioned document to design a multi-layer ball with bigger panels in such a way that the single panels are already formed according to the spherical shape of the ball. Thereby, it is especially provided that each panel is designed cup-shaped in a section by a deep-drawing process, wherein the lateral areas of the cup-shaped structure are joined together. Hereby, the advantage is obtained indeed that clear boundary surfaces of the panels and thus of the joining areas are created; also, the panels have a high rigidity in their edge region. However, it is detrimental in such a solution that just by this effect no equal hardness and spring constant respectively across the extent of the circumference (i. e. for example along great circles, which run along the ball surface) is obtained when the ball is charged with a force acting perpendicular to the ball surface.

Thus, it is the object of the invention to create a method of the kind mentioned at the beginning and to create a ball by which it becomes possible to obtain a steady spring constant and hardness respectively as possible along the ball surface when the ball is charged—as it is the case in the classical force situation for example during a shot in a soccer game—with a force acting perpendicular to the ball surface. Thereby, the method should allow a simple and thus economical production of the ball.

The solution of this object according to the method of the invention is characterized in that before, during or after the cutout of panels of a desired form from the base material at least the edge region of the panel is heated and a reforming of the edge area takes place, such that the side of the panel which is covered by the cover layer takes on a convex, i. e. rounded, shape in the edges area.

Preferably, but not mandatory, the cutting out of the panels takes place simultaneously with the heating and the reforming of the panel.

The heating of the panel takes place preferably by applying a high frequent electromagnetic radiation onto the base material.

The reforming of the panel takes place preferably by embossing, wherein an embossing tool is pressed onto the surface of the base material.

The application of the panels onto the carrier body (ball bladder) can take place by adhesive bonding, so that the edge areas of adjacent panels abut.

The panels which are brought onto the carrier body are preferably not sewed with another. Thus, a seamless ball is then given which is produced with the method.

A thermoplastic plastic material can be used for at least one layer of the base material. A thermoplastic urethane material can be used for at least one layer of the base material.

The proposed ball, especially the soccer ball, comprises an outer covering made of a plurality of panels, wherein the panels are applied onto a carrier body. According to the invention it is characterized in that the panels consist of a flat, level base material constructed in at least two layers which comprises a cover layer and at least one material layer below said cover layer, wherein the side of the panel which is covered by the cover layer has a convex shape in the edges area of the panel.

The convex shape of the panel extends preferably along an extension of the edge, which is between 3% and 20% of the width of the panel, preferably between 5% and 15% of the width of the panel. The thickness of the panel can be reduced by the convex shape of the panel at the edge of the panel by a value, which is between 80% and 20% of the thickness of the panel, preferably between 70% and 35% of the thickness of the panel. The gradient angle of the panel to the surface of the panel is preferably between 20° and 60°, specifically preferred between 25° and 35°.

Advantageously, the panels are glued on the base body, especially on the ball bladder. At least one layer of the base material is preferably a thermoplastic plastic material. Thereby, at least one layer of the base material is preferably a thermoplastic polyurethane material.

Thereby, the base material is preferably an at least three-layer composite, wherein the same comprises an upper skin layer made of aliphatic polyurethane, a layer thereunder made of non-foamed polyurethane and at least one layer thereunder made of foamed polyurethane. Thereby, at least two layers made of foamed polyurethane can be arranged one upon the other, wherein the same are foamed in different degrees. It is specifically proven that at least one of the layers consists of water-based polyurethane foam.

In the drawing an embodiment of the invention is depicted.

Figure 2:
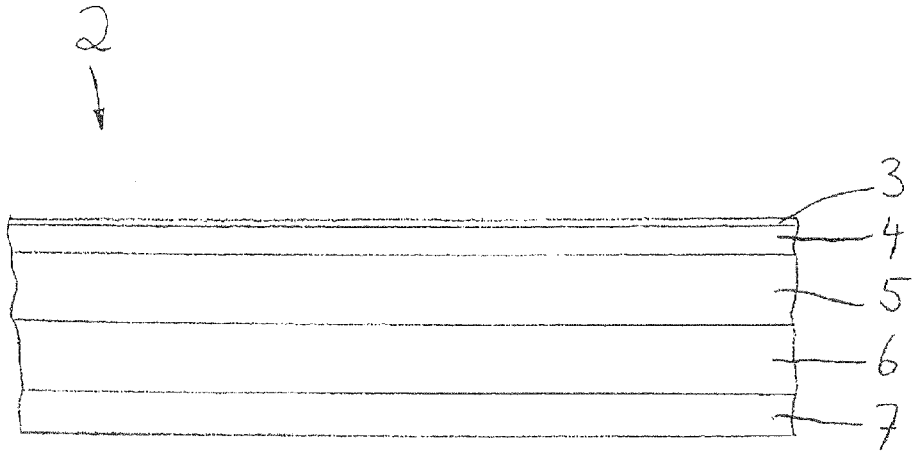
Figure 3:
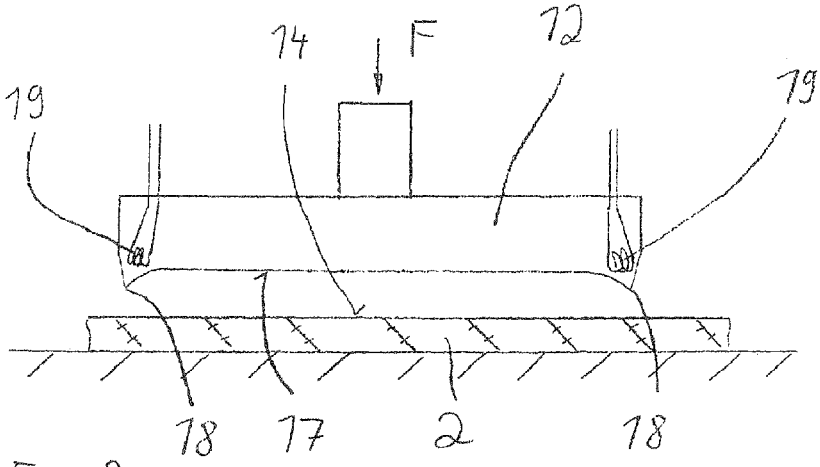
Figure 4:
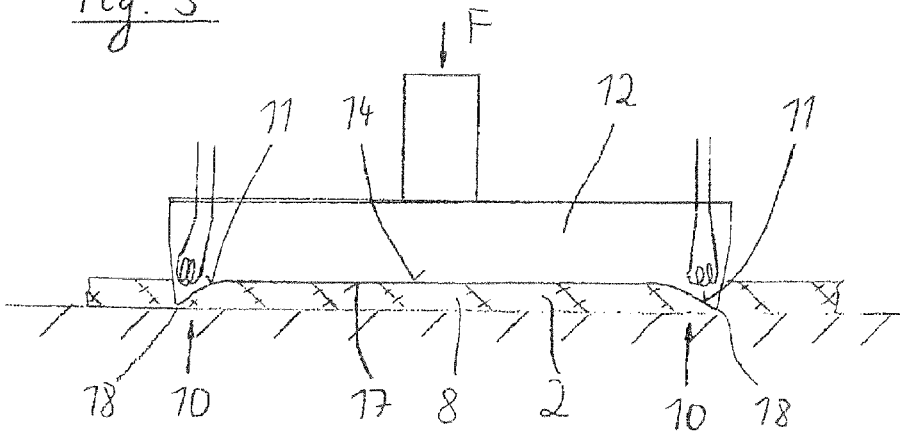
Figure 5:
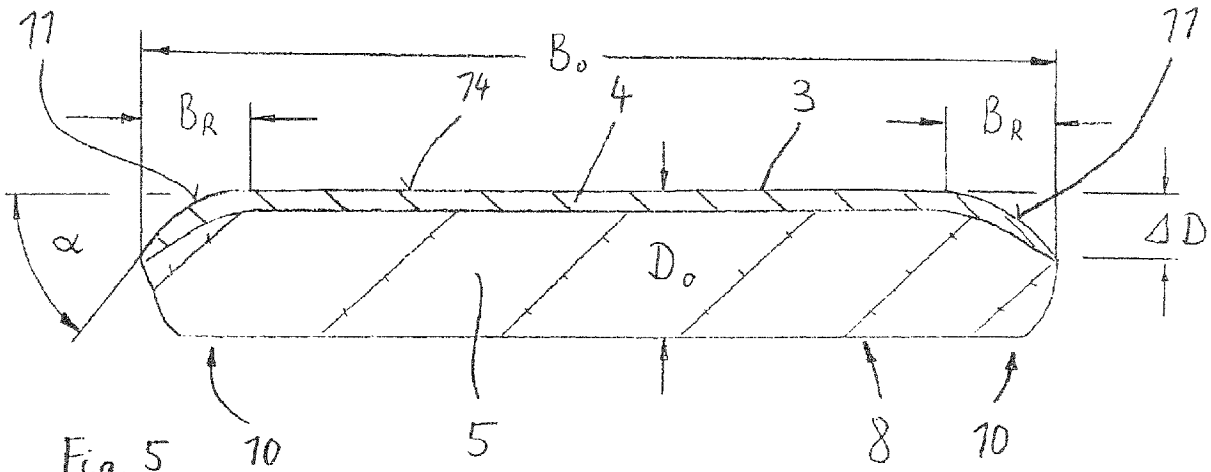

FIG. 1 shows a soccer ball, which is produced by the proposed method,

FIG. 2 shows schematically a multi-layer material composite being the base material, which is the primary material for the panels of the ball being a flat, level sheet, FIG. 3 shows schematically the base material, placed in a production device which comprises an embossing tool, wherein the embossing tool is not yet contacting the base material, FIG. 4 shows schematically the base material which is now charged by the embossing tool in the production device, FIG. 5 shows a cross section of a finished panel in the side view and shows a section of a ball according FIG. 1, wherein the cross section along a great circle of the ball is depicted.

In FIG. 1 a soccer ball 1 is shown, designed in a classical manner. Panels 8 are applied on a carrier body (see reference numeral 9) in the form of a ball bladder—which by itself is not shown in FIG. 1. Those panels have either a pentagonal shape (see pentagons 15) or a hexagonal shape (see hexagons 16), which are arranged to one another in known manner. The panels 8 abut to another whereby junctions 13 are created. Presently, it is essential that the panels are glued on the carrier body 9, wherein they are not sewed with another. Thus, the soccer ball is seamless.

The single panels 8 are cut out from a flat base material 2, which is schematically shown in FIG. 2. Presently, the base material 2 has five layers, i. e. it has five layers 3, 4, 5, 6, and 7 which are arranged one upon the other, wherein the topmost layer 3 is a thin cover layer. The base material can be produced as a multi-layer composite in a production process so that it is not necessary to produce the single layers separately and to glue them to another.

As an example of a five-layer composite of the base material the following should be mentioned: Five layers made of polyurethane are used, from which three have a foamed structure.

The topmost layer (cover layer) 3 consists of an aliphatic polyurethane and is employed to obtain a good resistance against light, i. e. it should specifically be prevented that white colors become yellowly in the sun light. Two kinds of aliphatic polyurethane can be used: The first kind has a polyol with a polycarbonate structure. This delivers a high resistance against hydrolysis and also a good light stability. The other kind has a higher modulus which ensures a good abrasion resistance. The combination of both kinds creates a ball surface with good physical properties. The first layer 3 is relatively thin and can have a thickness between 0.01 and 0.05 mm, preferably of 0.03 mm. The density of this layer lies between 1.1 and 1.3 g/cm$^3$, preferably at 1.2 g/cm$^3$.

The second layer 4 consists of an aliphatic polyurethane with higher density. Also here, the light stability and the capability of resistance against hydrolysis and abrasion are high and good respectively. This polyurethane has a smaller modulus as the above mentioned components of the layer 3, so that the material of the second layer 4 is softer. This increases the "holding properties" of the ball, but does not influence detrimentally the rebound properties of the ball. The second layer can have a thickness between 0.1 and 0.3 mm, preferably of 0.2 mm. The density is lower than that one of the first layer and lies between 1.0 and 1.2 g/cm$^3$, preferably at 1.1 g/cm$^3$.

The third layer 5 is a layer which uses a mixture of polyester and polyether-based polyurethane. Additionally, a foamed structure is employed which is produced by adding a chemical blowing agent. The foam has a well distributed equal froth bubble structure with regular formed micro cells. Again, two types of solid polyurethane are used. One of them is a polyether type with very good elastic properties and again beneficial hydrolysis properties. The other type is a polyester, however with a very soft modulus.

The combination of those types delivers a good grip of the ball, but also a beneficial rebound property is kept.

The fourth layer 6 employs an aliphatic water-based polyurethane foam. Again, the material has very beneficial physical properties, especially a high hydrolysis resistance. The foam is presently not obtained by addition of a chemical blowing agent but by mechanical treatment by further addition of additives to produce a foamed film.

The fifth and lowermost layer 7 is similar to the fourth layer 6, i. e. it is again a water-based polyurethane foam layer. The difference to the fourth layer 6 is the degree of foaming. The density of the foam can be influenced because both layers are mechanically foamed. As the density of the foam has an influence to the grip of the ball, the properties of the ball can be influenced insofar without changing the rebound properties. It is essential that the density of the foam can be adapted to adjust a different energy absorption, what allows to influence the energy delivery during a shot, however to keep the checkability of the ball.

The foam layers have a thickness between 0.6 mm and 3.0 mm, preferably of 0.8 mm (layer 6) and of 2.7 mm (layer 7). The density lies between 0.15 and 0.8 g/cm$^3$, preferably at 0.6 g/cm$^3$ (layer 6) and at 0.3 g/cm$^3$ (layer 7).

If all layers of the base material have thermoplastic properties the subsequently described production of the panels is possible in a specific beneficial manner by the use of a high-frequency electro-magnetic radiation, as it is used and known for the high-frequency welding.

The single panels 8 are punched out of the base material 2 with an embossing tool 12 and formed by the same as it is schematically depicted in the FIGS. 3 and 4. The embossing tool 12 has a moulding surface 17 which is pressed onto the surface of the base material 2 during the production of the panel and which is copied to the base material at least insofar as it can be subjected to a thermoplastic deformation.

The embossing tool 12 has also blade-like edges 18 in its lateral circumferential region which can cut out and punch out respectively a. piece from the plane base material 2 as it corresponds to the desired form of the panel (i. e, especially a pentagonal or hexagonal form; but of course all other shapes of the panels are also possible).

Especially the edge region of the embossing tool 12 is—corresponding to the edge area 10 of the panel 8 to be produced—equipped with a high-frequency exciter 19, as it is shown in FIGS. 3 and 4 however only very schematically. For example it is possible with the high-frequency exciter to bring in a high frequency power of about 2,500 W about 2 seconds into the base material 2, wherein a pressure of about 50 bar is exerted onto the base material by the embossing tool 12. The pressure generation takes place by executing a force F in a manner as denoted in FIGS. 3 and 4. This causes that the base material is heated up in such a way that a thermoplastic deforming process can be activated.

Thereby, the parameter for the intensity and duration of the high-frequency application occurs in such a manner, that no damage of the material takes place.

As the moulding surface 17 has a concave form in the edge region in cross section, a congruent convex form 11 is formed on the surface 14 of the panel accordingly. As it is denoted in FIG. 4 this thermoplastic deformation process takes place simultaneously with cutting out of the desired panel form from the base material by the edges 18 (punching out).

The obtained panel 8 can be seen in FIG. 5 from the side in a cross section, wherein due to the clarity only two layers are shown of which the material of the panel consists.

It is essential that the material which has a substantial constant thickness along the area experiences a thickness reduction in the edge area 10 which results from the convex form 11. As can be seen the panel 8 has a constant thickness along the whole width $B_0$ of the panel 8, disregarding the extension of the edge $B_R$ in which the convex form 11 leads to a reduction in the panel thickness. Concretely, the thickness of the panel $D_0$ in the edge area 10 is reduced till the edge by a reduction of the thickness $\Delta D$. The surface 14 of the panel comes up in the region of the convex form 11 under a tangential measured gradient angle $\alpha$.

Figure 6:
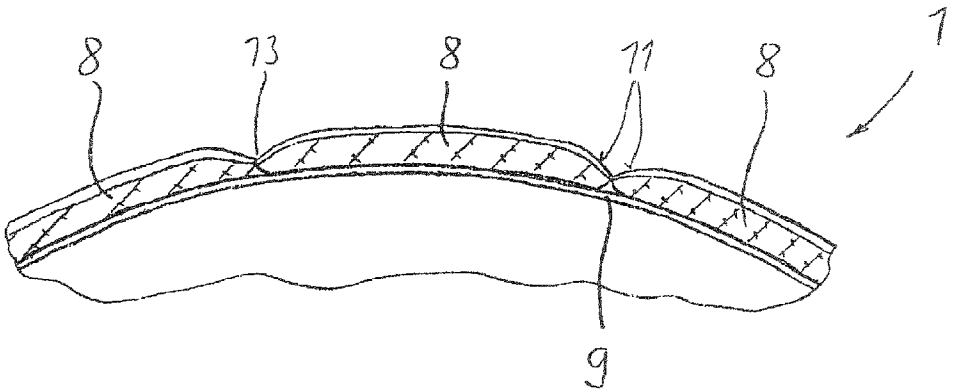

The panels which are produced in such a way are glued on the ball bladder 9 (under which also the carcass has to be understood) according to FIG. 6 so that the panels 8 abut at the junctions 13.

By choice of the parameters extension of the edge $B_R$, reduction of the thickness $\Delta D$ and gradient angle $\alpha$ the finally resulting characteristic of the ball can be influenced where the progress of the spring constant and hardness respectively along the circumference is concerned. If—as it is known in the state of the art according to DE 102 55 092 A1—only a glueing of the edges of the panels would take place or if here even the cup-shaped regions of the panels abut, an increased stiffness and hardness respectively result at the concerned locations. However, the stiffness and hardness would drop in the edge area compared with the remaining panel in the case that the reduction of the thickness would be chosen too high. Thus, the man skilled in the art can determine the desired progress of the stiffness and hardness respectively by suitable selection of the parameters.

The ball bladder is produced in known manner. A carcass is formed from a polyester or cotton fabric and sewed. A bladder is then inserted in the same. After inflating the surface can be supplied with a layer of latex adhesive. Then, the panels can be inserted in a mould with respective recessions for the panels, whereupon the prepared carcass is inserted into the mould and the mould is closed, whereupon the bladder is inflated. After this process the ball can be inspected.

The ball which is produced accordingly is substantial waterproof.

REFERENCE NUMERALS

1 Ball
2 Base material
3 Layer (cover layer)
4 Layer
5 Layer (foamed)
6 Layer (foamed)
7 Layer (foamed)
8 Panel
9 Carrier body (ball bladder)
10 Edge area
11 Convex shape
12 Embossing tool
13 Junction
14 Surface
15 Pentagon
16 Hexagon
17 Moulding surface
18 Edge
19 High frequency exciter
$B_R$ Extension of the edge
$B_0$ Width oldie panel
$D_0$ Thickness of the panel
$\Delta D$ Reduction of the thickness of the panel in the edge area
$\alpha$ Gradient angle
F Force

The invention claimed is:

1. A method for producing a ball, comprising the steps:
a) producing a flat, level base material, having at least two layers which comprises a cover layer and at least one material layer below said cover layer;
b) cutting out panels of the desired shape from the base material;
c) applying the panels to a carrier body so that adjacent panels directly abut each other; and
d) heating and reforming edge areas of the panel, before, during or after step b), such that the side of the panel which is covered by the cover layer takes on a convex shape in the edge areas, and the convex shape is joined to the surface of the panel between the edge areas continuously and has a gradient angle to the surface of the panel between 20 and 60°.

2. The method of claim 1, wherein the cutting out of the panels according to step b) takes place simultaneously with the heating and the reforming of the panel.

3. The method of claim 1, wherein the heating of the panel takes place by applying a high frequency electromagnetic radiation onto the base material.

4. The method of claim 1, wherein the reforming of the panel takes place by embossing, wherein an embossing tool is pressed onto the surface of the base material.

5. The method of claim 1, wherein the carrier is a ball bladder and the application of the panels onto the ball bladder takes place by adhesive bonding, so that the edge areas of adjacent panels abut.

6. The method of claim 1, wherein the panels which are applied onto the carrier body are not sewed with another.

7. The method of claim 1, wherein a thermoplastic plastic material is used for at least one layer of the base material.

8. The method of claim 7, wherein a thermoplastic urethane material is used for at least one layer of the base material.

9. A ball, comprising
an outer covering made of a plurality of panels, the panels are applied onto a carrier body such that the adjacent panels directly abut each other,
the panels consist of a flat, level base material having at least two layers which comprises a cover layer and at least one material layer below said cover layer,
the sides of the panel which is covered by the cover layer has a convex shape in edge areas of the panel, and
the convex shape is joined to the surface of the panel between the edge areas continuously and has a gradient angle to the surface of the panel is between 20° and 60°.

10. The ball of claim 9, wherein the convex shape of the panel extends along an extension of the edge, which is between 3% and 20% of the width of the panel.

11. The ball of claim 9, wherein the thickness of the panel is reduced by the convex shape of the panel at the edge of the panel by a value, which is between 80% and 20% of the thickness of the panel.

12. The ball of claim 9, wherein the panels are glued on the carrier body.

13. The ball of claim 9, wherein at least one layer of the base material is a thermoplastic material.

14. The ball of claim 13, wherein at least one layer of the base material is a thermoplastic polyurethane material.

15. The ball of claim 9, wherein the base material is an at least three-layer composite, wherein the same comprises an upper skin layer made of aliphatic polyurethane, a layer thereunder made of non-foamed polyurethane and at least one layer thereunder made of foamed polyurethane.

16. The ball of claim 15, wherein at least two layers made of foamed polyurethane are arranged one upon the other, wherein the same are foamed in different degrees.

17. The ball of claim 15, wherein at least one of the layers consists of water-based polyurethane foam.

18. The method of claim 1, wherein the gradient angle is between 25° and 35°.

* * * * *